US008851283B2

(12) United States Patent
Wu

(10) Patent No.: US 8,851,283 B2
(45) Date of Patent: Oct. 7, 2014

(54) DISPLAY AND STORAGE TOOL BOX

(76) Inventor: Kuo Hsien Wu, Taichung (TW)

( * ) Notice: Subject to any disclaimer, the term of this patent is extended or adjusted under 35 U.S.C. 154(b) by 286 days.

(21) Appl. No.: 13/452,470

(22) Filed: Apr. 20, 2012

(65) Prior Publication Data

US 2013/0277243 A1 Oct. 24, 2013

(51) Int. Cl.
*B65D 85/24* (2006.01)

(52) U.S. Cl.
USPC ..... 206/377; 206/378; 206/379; 206/234

(58) Field of Classification Search
USPC ..... 206/216, 234, 372, 373, 377, 378, 379, 206/423
See application file for complete search history.

(56) References Cited

U.S. PATENT DOCUMENTS 5,379,885 A * 1/1995 Chen ..... 206/216
5,512,165 A * 4/1996 Liu ..... 206/234
6,360,891 B1 * 3/2002 Rideout ..... 206/373
6,547,074 B1 * 4/2003 Chen ..... 206/379
6,901,681 B2 * 6/2005 Bueno ..... 33/647
7,168,559 B2 * 1/2007 Chen ..... 206/373
7,661,526 B2 * 2/2010 Lin ..... 206/379
7,780,017 B2 * 8/2010 Nguy et al. ..... 211/70.6
7,954,650 B1 * 6/2011 Malik ..... 211/70.6
8,302,771 B2 * 11/2012 Arslan ..... 206/372
8,469,190 B1 * 6/2013 Chang ..... 206/372

* cited by examiner

*Primary Examiner* — Anthony Stashick
*Assistant Examiner* — Ernesto Grano

(57) ABSTRACT

A tool box includes a main part having a connection portion and a locking member which is directly or indirectly connected to the connection portion. A restriction portion and a block extend from the main part. A reception portion is defined therein so as to receive objects therein. A base has a connection portion supporting the restriction portion of the main part and the locking member connects the main part to the base. A recess is defined in the base and the blocks are located above the recess. A positioning portion is located in the base and restricts the locking member. A movable part has a pivot which is rotatably located in the recess of the base. A locking portion of the movable part connects the movable part to the main part. An inner box is located in the movable part so as to receive tools therein.

11 Claims, 9 Drawing Sheets

DISPLAY AND STORAGE TOOL BOX

FIELD OF THE INVENTION

The present invention relates to a tool box, and more particularly, to a display and storage tool box.

BACKGROUND OF THE INVENTION

The conventional tool box is made by hollow and plastic top part and a bottom part is connected to the top part. A handle is connected to the pivots of the top part and a locking unit connected to the top and bottom parts. There are multiple recesses of different shapes defined in the top and bottom parts so as to receive tools such as sockets, bits and wrenches therein. By the locking unit, the tools are positioned between the top and bottom parts and the user carries the tool box by the handle.

However, when the tool box is used for display purposes, the conventional tool box can only be opened by opening the top part relative to the bottom part and this way occupies too much space. The tool boxes cannot attract the customers' attentions and limited number of the tool boxes can be displayed. When removing the tools from the tool box, the tools can only be put on the floor randomly. The tools may be lost or the user has to take a while to find out a specific tool. When the tool box is not in use, the tool box is stored in the cabinet or rack, however, the tool box occupying space requires significant space which is not affordable for some of the users.

The present invention intends to provide a tool box that can be used for display and storage and improves the shortcomings of the conventional tool boxes.

SUMMARY OF THE INVENTION

The present invention relates to a tool box and comprises a main part having a connection portion and a locking member which is directly or indirectly connected to the connection portion. A restriction portion and a block extend from the main part. A reception portion is defined therein so as to receive objects therein. A base has a connection portion supporting the restriction portion of the main part and the locking member connects the main part to the base. A recess is defined in the base and the blocks are located above the recess. A positioning portion is located in the base and restricts the locking member. A movable part has a pivot which is rotatably located in the recess of the base. A locking portion of the movable part connects the movable part to the main part. An inner box is located in the movable part so as to receive tools therein.

The primary object of the present invention is to provide a tool box which uses a locking member to connect the main part to the base, the main part has blocks located above the recesses of the base to restrict the pivots of the movable part to be pivoted between the blocks and the recesses, so that the movable part is able to be pivoted upward or downward to provide more display area.

The tool box is assembled to form a vase-like status which occupies less space and flowers can be inserted into the main part to have decorative feature. The movable part can be pivoted downward to display the tools 360 degrees and this attracts people's attentions. The movable part and the inner box can be replaced and carried individually.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figures 1, 2:
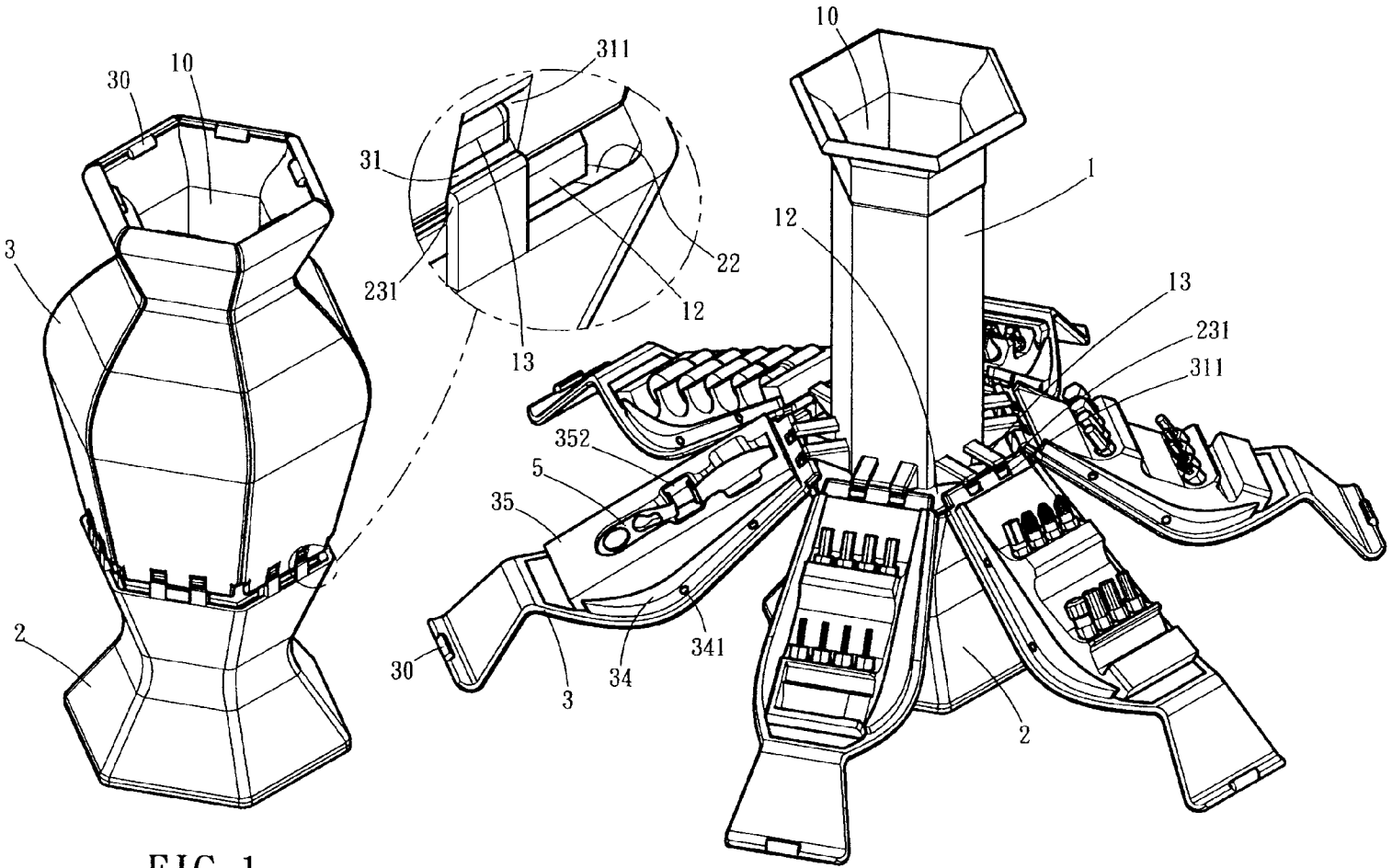
FIG. 1 is a perspective view to show the tool box of the present invention.
FIG. 2 shows the display status of the tool box of the present invention.
Figure 3:
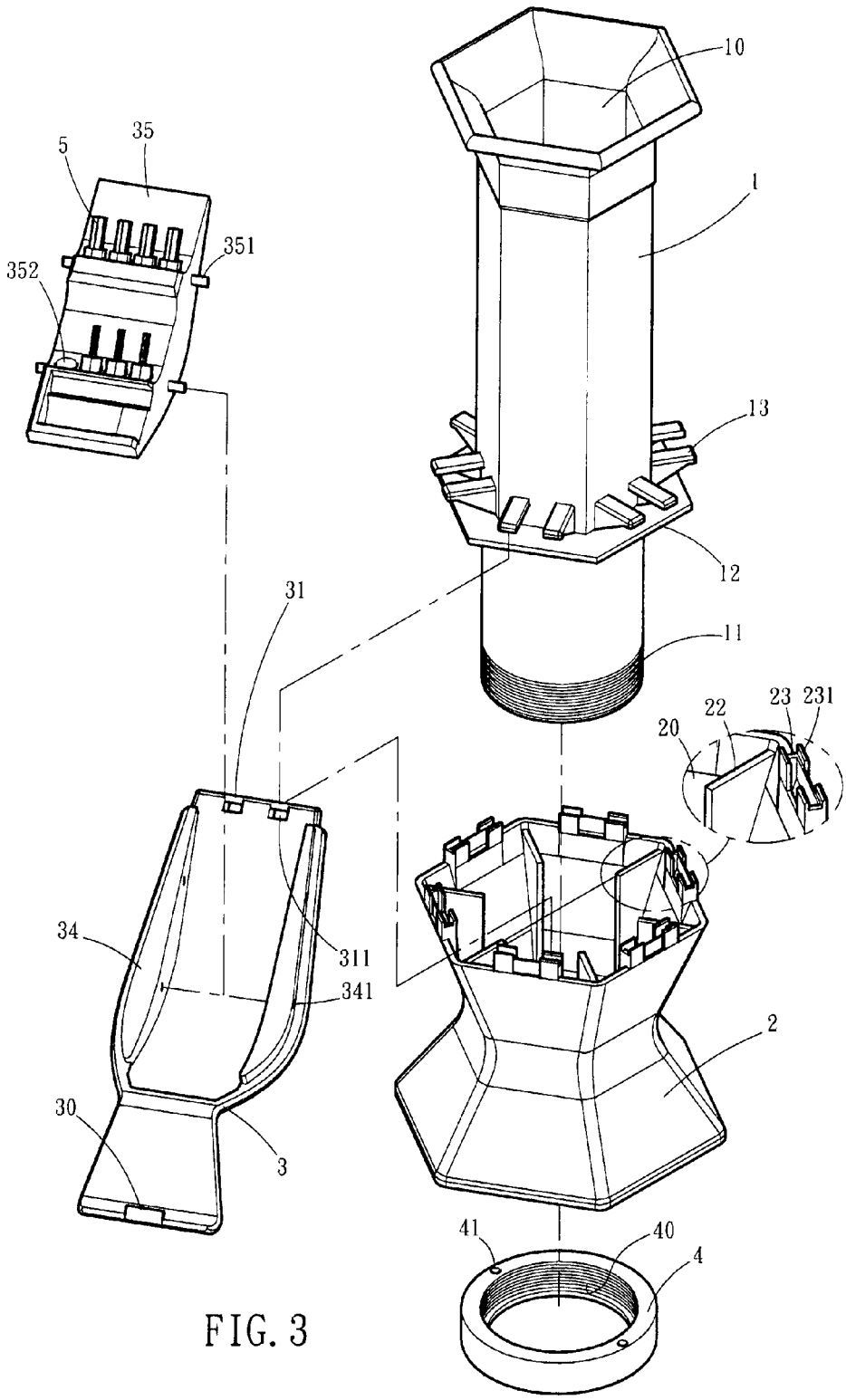
FIG. 3 is an exploded view to show the tool box of the present invention.
Figure 4:
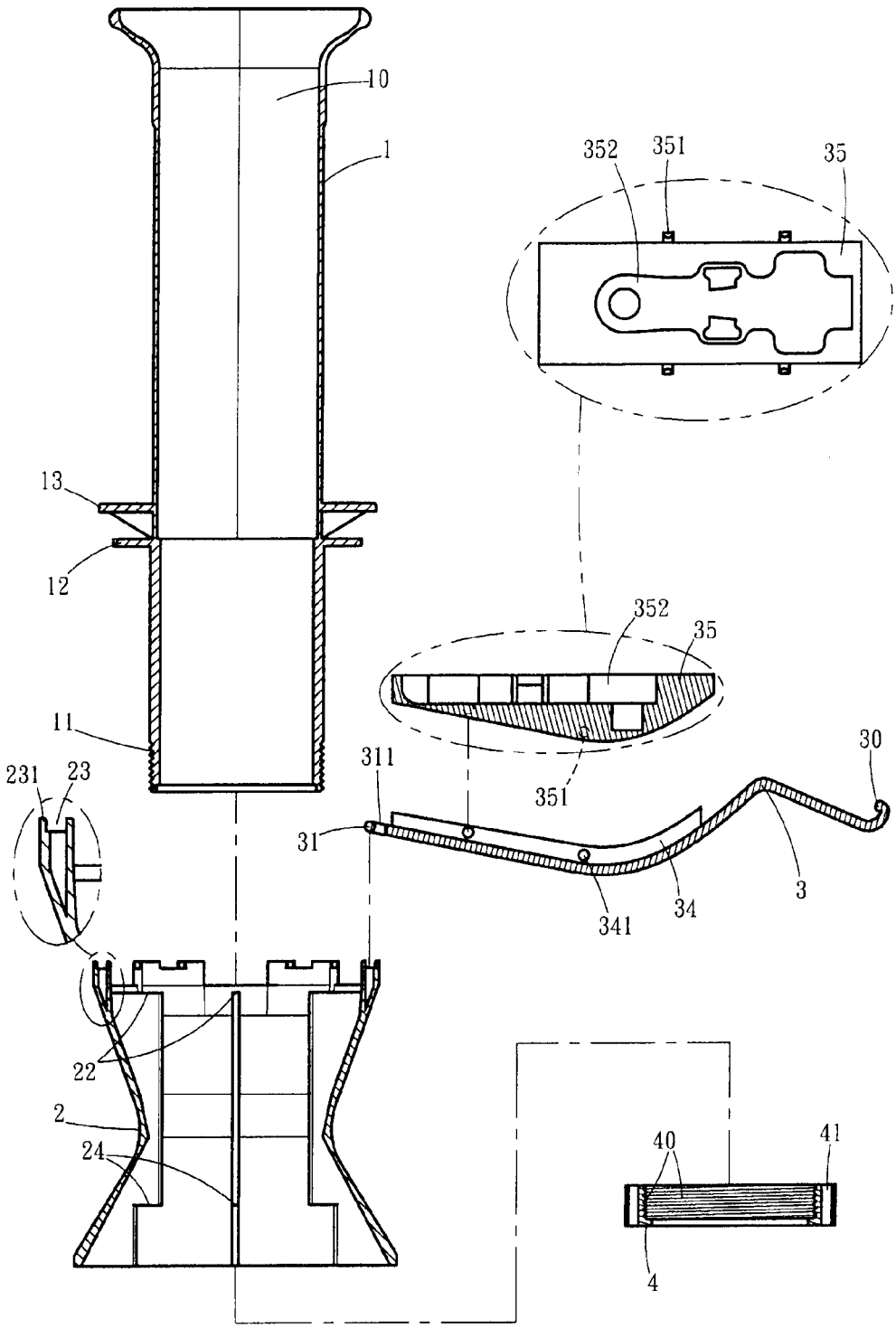
FIG. 4 is another plane exploded view to show the tool box of the present invention.
Figure 7:
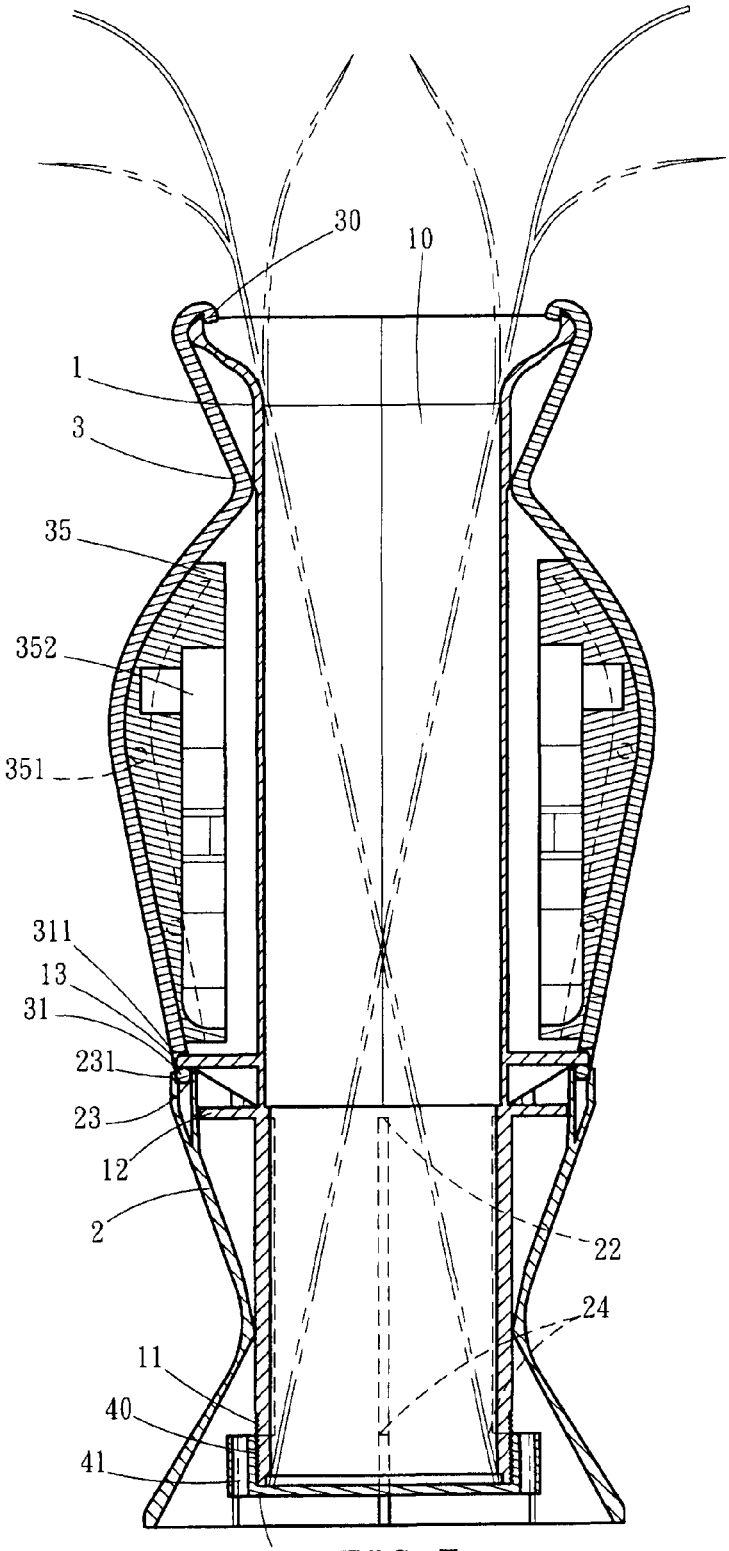
FIG. 7 is a cross sectional view of the second embodiment of the tool box of the present invention.
Figure 8:
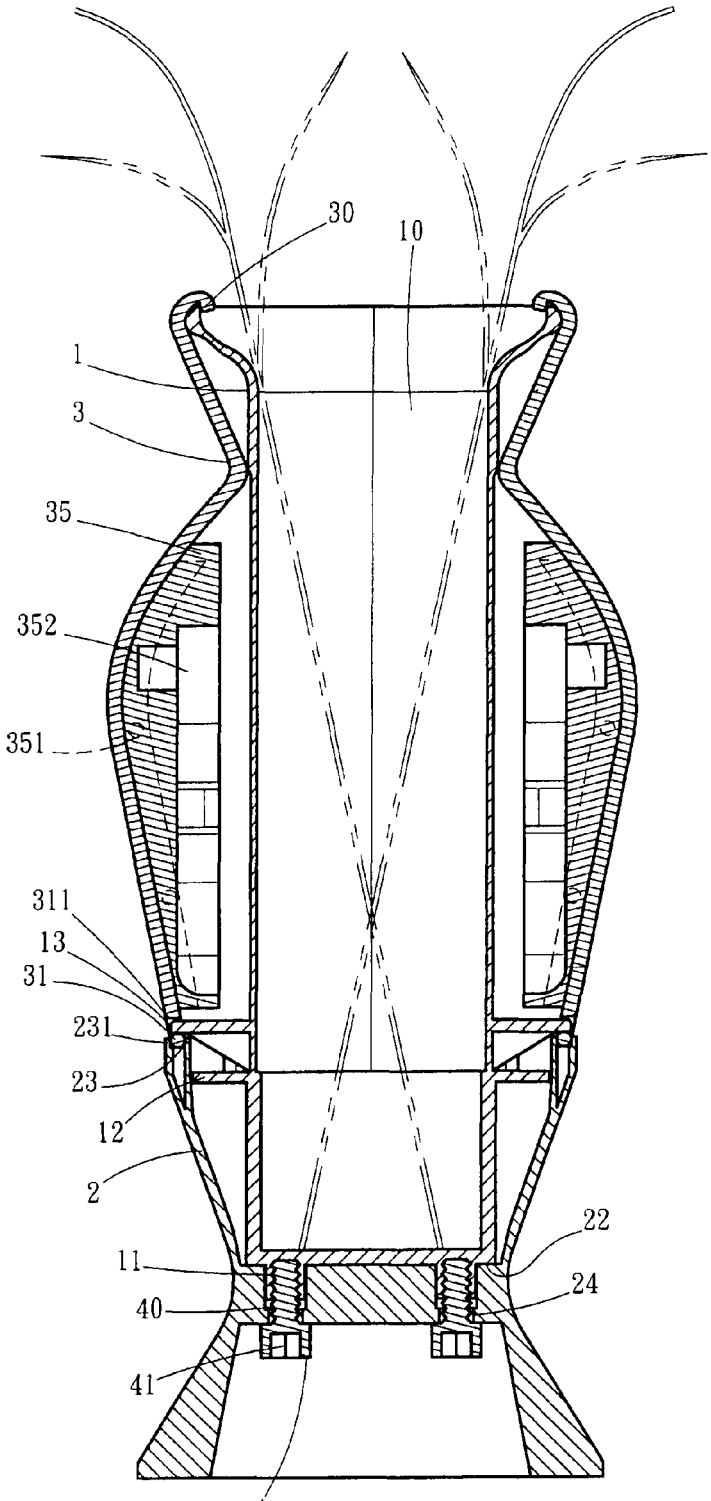
FIG. 8 is a cross sectional view of the third embodiment of the tool box of the present invention.
Figure 9:
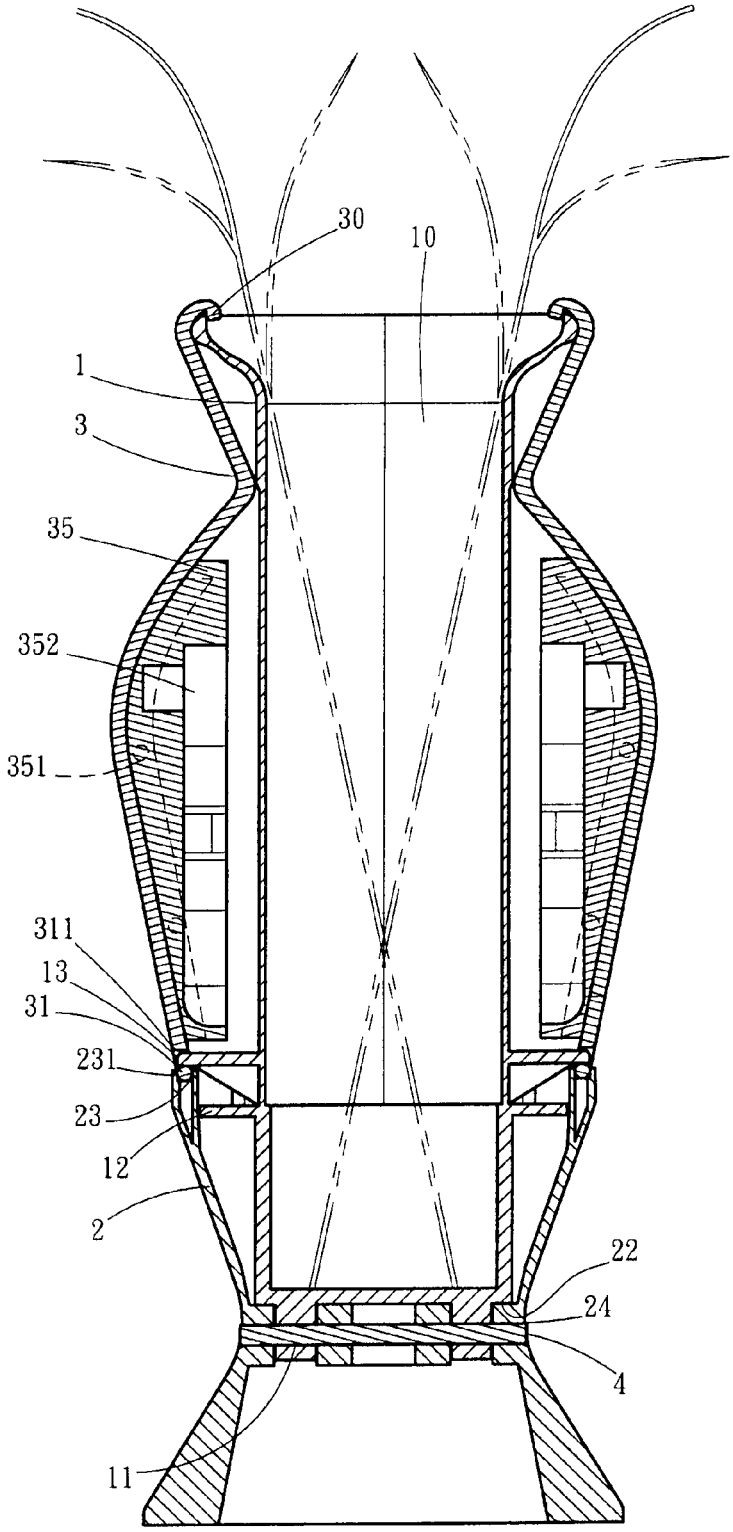
FIG. 9 is a cross sectional view of the fourth embodiment of the tool box of the present invention.

Referring to FIGS. 1 to 9, the tool box of the present invention comprises a main part 1 having a reception portion 10 and a connection portion 11 to which a locking member 4 is connected. A restriction portion 12 and multiple blocks 13 extend from the outer surface of the main part 1. The connection portion 11 can be threads as shown in FIG. 3, or a slot or a hole as shown in FIG. 9. The connection portion 11 is located at the lower end of the main part 1 so that the locking portion 40 of the locking member 4 is connected to the connection portion 11 of the main part 1 to connect the main part 1 to the base 2. The locking member 4 seals the lower end (the underside of the hollow reception portion 10) of the main part 1 so that the reception portion 10 has the only opening at the top thereof. The tools 5 picked from the inner box 35 or other parts or even flowers can be put in the reception portion 10 from the top opening.

A base 2 has multiple contact portions 22 which support the restriction portion 12 of the main part 1. The restriction portion 12 is a board-like piece and contacts the contact portions 22 of the base 2 to prevent the main part 1 from slipping into the space 20 of the base 2. The restriction portion 12 may also position the main part 1 to the base 2. Multiple recesses 23 are defined in the top of the base 2 and the blocks 13 are located above the recesses 23. Multiple positioning portions 24 are located in the base 2 and restrict the locking member 4. The contact portions 22 and the positioning portions 24 are located on two different positions (the top portion and the lower portion) of the base 2. Preferably, the contact portions 22 and the positioning portions 24 respectively face two sides of two ridges extending from the center of the space 20. The recesses 23 are located above the top of the base 2 and two ribs 231 are located on two sides of the recess 23 to form the recess 23 as a U-shaped recess which is located beneath the blocks 13. Multiple movable parts 3 each have a pivot 31 which is rotatably located in the recess 23 of the base 2. The smallest distance between the top of the rib 231 and the underside of the block 13 is smaller than the diameter of the pivot 31 of the movable part 3. The pivot 31 of the movable part 3 is then restricted in the room 311 defined between the block 13 and the recess 23. The inner box 35 is located in each of the movable part 3 for receiving the tools 5. Each of the movable parts 3 has a resilient locking portion 30 which is locked to the opening of the reception portion 10. The room 311 is located beside the pivot 31 of the movable part 3 and yields to the block 13 or the rib 231 when the movable part 3 is pivoted upward or downward. By the arrangement, when the movable parts 3 can be folded and positioned to the main part 1, or the movable parts 3 are pivoted outward and radially from the main part 1 as shown in FIG. 2. The inner box 35 and the movable part 3 are made integrally or composed by two independent parts which are directly or indirectly connected to each other, such as by use of bolts, springs, pins or springs and beads. For the example of two independent parts, the inner box 35 has two protrusions 351 extending from two sides thereof so as to be engaged with the holes 341 or slots on two sides of the ridge 34 of the movable part 3. The protrusions 351 can be replaced by holes or slots, and the holes 341 or the slots on two sides of the ridge 34 can also be replaced by protrusions. Each inner box 35 has a reception area 352 for receiving the tools 5 such as wrenches, or screwdrivers, or parts such as the extension rods, sockets and screw bits. The locking member 4 can be a bolt, a nut or a pin and has a locking portion 40 and a driving portion 41. So that the locking portion 40 is connected to the connection portion 11 of the main part 1 to securely connect the main part 1 and the base 2. The locking portion 40 can be inner threads, outer threads, a teeth rack, a circular hole or a polygonal hole. The driving portion 41 is located on the end surface of the peripheral surface of the locking member 4, and can be a hole, a slot, a rib, a regular or irregular portion.

Figure 5:
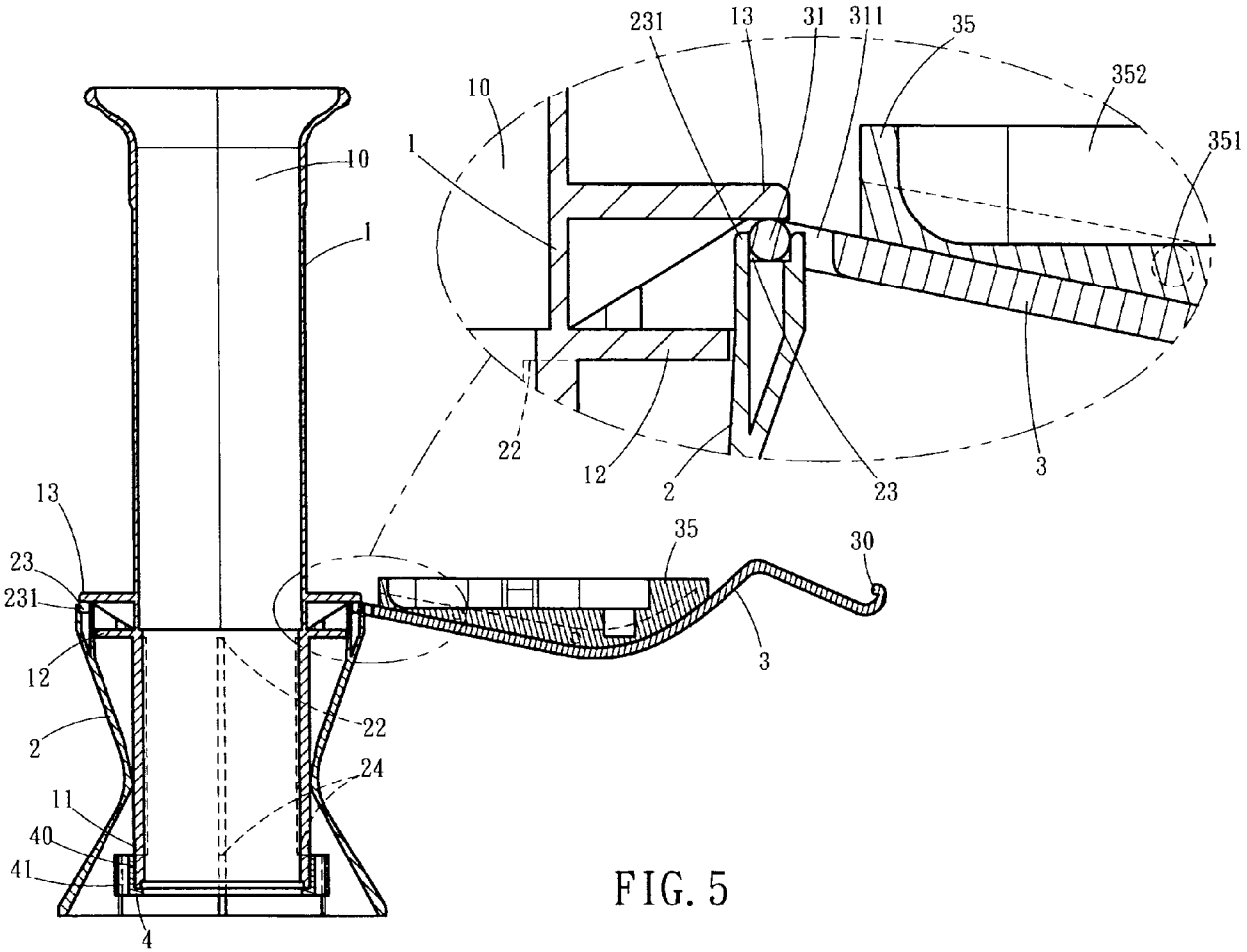
FIG. 5 is a plane and cross sectional view to show the movable part is pivoted downward.
Figure 6:
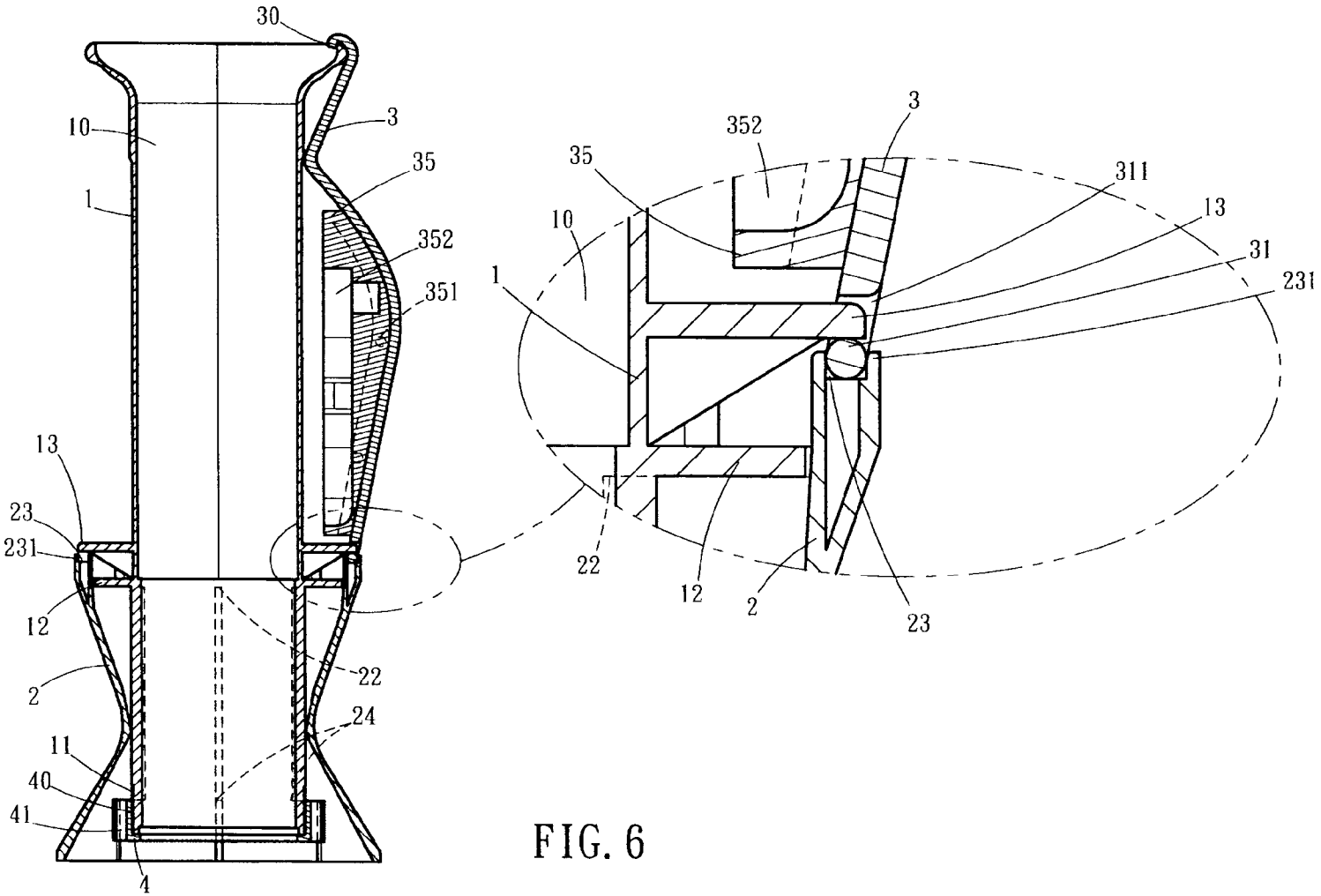
FIG. 6 is a plane and cross sectional view to show the movable part is pivoted upward.

When assembling, the pivots 31 of the movable parts 3 are engaged with the recesses 23 of the base 2 to let the ribs 231 on two sides of the recess 23 be located in the rooms 311. The main part 1 is inserted into the space 20 by the connection portion 11 until the restriction portion 12 and the blocks 13 are respectively in contact the contact portions 22 of the base 2 and the pivots 31 located in the recesses 23. The connection portion 11 of the main part 1 extends beyond the lower end of the positioning portion 24 of the base 2 so that the locking portion 40 of the locking member 4 is directly connected to the connection portion 11 of the main part 1. By rotating the driving portion 41, the locking portion 40 is threadedly connected to the connection portion 11 of the main part 1 until the main part 1 and the base 2 are securely connected to each other. The locking member 4 is in contact the positioning portion 24 of the base 2 and the restriction portion 12 of the main part 1 is in contact with the contact portion 22 of the base 2. The inner boxes 35 with the protrusions 351 are engaged with the holes 31 of the ribs 34 of the movable parts 3 to connect the inner boxes 35 to the movable parts 3 as shown in FIG. 5. The movable parts 3 are pivoted upward and about the pivots 31 located between the recesses 23 and the blocks 13 until the locking portions 30 on the movable parts 3 are connected to the opening of the reception portion 10 of the main part 1. That is to say, the pivots 31 are restricted by the blocks 13 and the slots 23, and the main part 1 and the base 2 are connected to each other as shown in FIG. 6. The movable parts 3 are then collected to the main part 1 and the tool box is folded and formed like a vase as shown in FIG. 1 and save the space required for storage.

When the tool box is put in a room, the dehydrated flower or the root of a plant can be put in the reception portion 10 of the main part 1 so that the tool box performs as a vase as shown in FIGS. 1 and 7.

The reception portion 10 of the main part 1 can also be used as a temporary storage space in which the parts or tools are stored.

When displaying the tools, the user removes the locking portions 30 of the movable parts 3 from the opening of the reception portion 10 of the main part 1, the movable parts 3 are able to be pivoted downward until the pivots 31 of the movable parts 3 are compressed by the blocks 13 and the outer surface of the movable parts 3 are in contact with the floor or the outside of the base 2. The inner boxes 35 of the movable parts 3 and the tools 5 in the inner boxes 35 are displayed around the tool box.

FIG. 7 shows the second embodiment of the present invention, wherein the difference is that the locking member 4 is changed from having a through hole to be having a recess, so that the locking member 4 is connected to the connection portion 11 of the main part 1 to seal the reception portion 10. The parts or tools in the reception portion 11 are then sealed temporarily.

FIG. 8 shows the third embodiment of the present invention, wherein the difference is that the reception portion 10 of the main part 1 is changed from having a through passage to be having a recessed area, and the connection portion 11 of the main part 1 is changed from having outer threads to be having inner threads. The locking member 4 is changed from a nut to a bolt. The inner threads of the connection portion 11 is located in the positioning portion 24 which has a passage and the bolt-type locking member 4 extends in the positioning portion 24 and is threadedly connected to the connection portion 11. The blocks 13 are located above the recesses 23 and restrict the movement of the pivots 31 so that the movable parts 3 can be pivoted upward or downward.

FIG. 9 shows the fourth embodiment of the present invention, wherein the difference is that the reception portion 10 of the main part 1 is changed from having a through passage to be having a recessed area, and the connection portion 11 of the main part 1 is changed from having outer threads to be having a through hole. The locking member 4 is changed from a nut to a pin. The main part 1 has one end inserted into the space 20 of the base 2, and the connection portion 11 is in alignment with the hollow positioning portion 24, the pin-type locking member 4 is directly inserted into the connection portion 11 and the positioning portion 24 to connect the base 2 to the main part 1. The blocks 13 are located above the recesses 23 and restrict the movement of the pivots 31 so that the movable parts 3 can be pivoted upward or downward.

Figure 10:
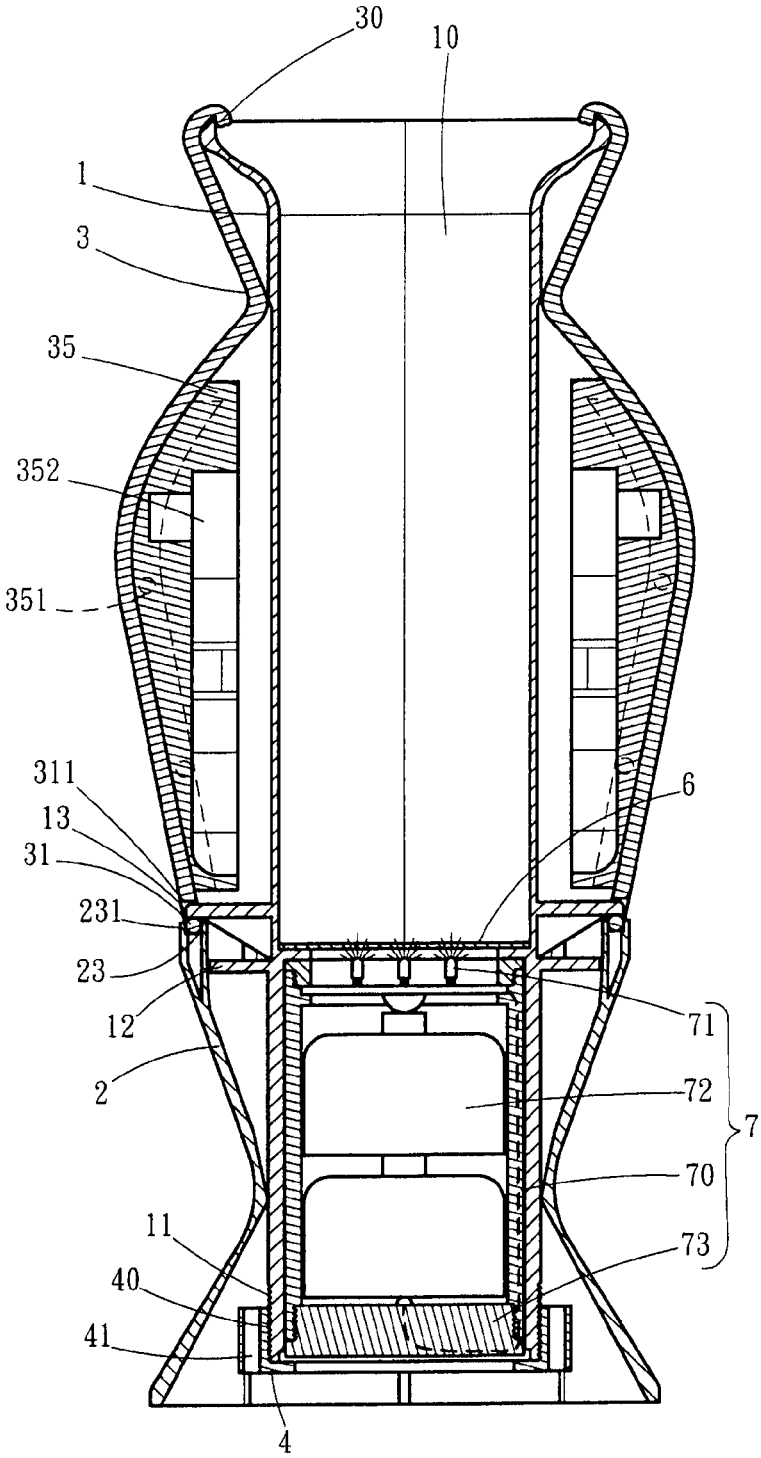
FIG. 10 is a cross sectional view of the fifth embodiment of the tool box of the present invention.

FIG. 10 shows the fifth embodiment of the present invention, wherein a transparent board 6 is installed in the reception portion 10 of the main part 1 and located at the lower portion and close to the center of the reception portion 10 which is then divided into two partitions. An illumination unit 7 is located in the lower partition and has a case 70, a Light Emitting Diode 71, a battery 72 and a battery cap 73. The locking member 4 is threadedly connected to the connection portion 11 of the main part 1 to securely connect the main part 1 and the base 2. The illumination unit 7 is secured in the main part 1 to provide illumination function.

While we have shown and described the embodiment in accordance with the present invention, it should be clear to those skilled in the art that further embodiments may be made without departing from the scope of the present invention.

What is claimed is:

1. A tool box comprising:

a main part having a connection portion and a locking member directly or indirectly connected to the connection portion, the connection portion of the main part having threads, the locking member having a locking portion which is threadedly connected to the threads to connect the main part to the base, a restriction portion and blocks extending from an outer surface of the main part, the main part having a reception portion for receiving parts therein;

a base having a contact portion which supports the restriction portion of the main part, the locking member connecting the main part to the base, multiple recesses defined in a top of the base and the blocks located above the recesses, each of the recesses of the base including a rib, a positioning portion located in the base and restricting the locking member, and multiple movable parts each having a pivot which is rotatably located in one of the recesses of the base, a smallest distance between a top of the rib of each of the recesses and an underside of each of the blocks being smaller than a diameter of the pivot of each of the movable parts, the pivot of each of the movable parts being restricted in a room defined between the block and the recess corresponding thereto, each of the movable parts having a resilient locking which is locked to an opening of the reception portion, an inner box located in each of the movable parts For receiving tools.

2. The tool box as claimed in claim 1, wherein the connection portion of the main part is a hole and the locking member has a locking portion which is connected to the hole to connect the main part to the base.

3. The tool box as claimed in claim, 1 wherein the connection portion of the main part is a slot and the locking member has a locking portion which is connected to the slot to connect the main part to the base.

4. The tool box as claimed in claim 1, wherein the room is located beside the pivot of the movable part and yields to each of the blocks or the rib of each of the recesses when the movable part is pivoted.

5. The tool box as claimed in claim 4, wherein the main part has an end thereof inserted into a space of the base.

6. The tool box as claimed in claim 1, wherein the base has a ridge located in a space of the base, the contact portion and the positioning portion are respectively located on two sides of the ridge.

7. The tool box as claimed in claim 6, wherein the locking member has a driving portion.

8. The tool box as claimed in claim 1, wherein the inner box of the movable part has a reception area, a connection between the movable part and the inner box is composed by two independent parts which are directly connected to each other, two protrusions extend from two sides of the inner box and engaged with the holes or slots on two sides of a ridge of the movable part.

9. The tool box as claimed in claim 1, wherein the inner box of the movable part has a reception area, a connection between the movable part and the inner box is composed by two independent parts which are indirectly connected to each other by using a bolt, a pin, or a bead unit.

10. The tool box as claimed in claim 1, wherein the inner box of the movable part has a reception area, the inner box and the movable box are made integrally.

11. The tool box as claimed in claim 6, wherein the reception portion of the main part has an illumination unit received therein, the illumination unit has a case, a Light Emitting Diode, a battery and a battery cap.

* * * * *